United States Patent [19]

Korach

[11] Patent Number: 4,469,808

[45] Date of Patent: Sep. 4, 1984

[54] PERMIONIC MEMBRANE ELECTROLYTIC CELL

[75] Inventor: Malcolm Korach, Pittsburgh, Pa.

[73] Assignee: PPG Industries, Inc., Pittsburgh, Pa.

[21] Appl. No.: 458,387

[22] Filed: Jan. 17, 1983

Related U.S. Application Data

[62] Division of Ser. No. 263,329, May 13, 1981, Pat. No. 4,389,297, which is a division of Ser. No. 195,570, Oct. 9, 1980, Pat. No. 4,299,675.

[51] Int. Cl.[3] ..... C25B 11/04

[52] U.S. Cl. ..... 502/101; 204/290 R

[58] Field of Search ..... 252/425.3; 204/290 R, 204/98; 502/101

[56] References Cited

U.S. PATENT DOCUMENTS

| | | | |
|---|---|---|---|
| 4,101,395 | 7/1978 | Montani et al. | 204/290 R |
| 4,248,680 | 2/1981 | Carlin et al. | 204/290 R |
| 4,251,478 | 2/1981 | Welch et al. | 204/290 R |
| 4,282,074 | 8/1981 | DuBois | 204/290 R |
| 4,299,675 | 1/1981 | Korach | 204/98 |
| 4,336,123 | 6/1982 | DuBois | 204/290 R |
| 4,364,813 | 12/1982 | White | 204/290 R |
| 4,369,103 | 1/1983 | White | 204/252 |
| 4,389,297 | 6/1983 | Korach | 204/290 R |

*Primary Examiner*—P. E. Konopka

*Attorney, Agent, or Firm*—Mark Levin; Richard M. Goldman

[57] ABSTRACT

Disclosed is the preparation of electrodes provided by depositing hydrophilic electrolyte resistant resin atop an electrocatalyst on a metallic substrate and treating the resin to cause it to flow whereby to obtain a firmly bonded assembly of resin, electrocatalyst and metallic substrate.

1 Claim, No Drawings

PERMIONIC MEMBRANE ELECTROLYTIC CELL

This is a division of application Ser. No. 263,329, filed May 13, 1981 now U.S. Pat. No. 4,389,297 which is a division of Application Ser. No. 195,570, filed Oct. 9, 1980, now U.S. Pat. No. 4,299,675.

DESCRIPTION OF THE INVENTION

Permionic membrane cells have a cation selective permionic membrane separating the anolyte liquor from the catholyte liquor. In a zero gap permionic membrane cell either the anodic electrocatalyst is removably in contact with the anolyte facing surface of the permionic membrane, or the cathodic electrocatalyst is removably in contact with the catholyte facing surface of the permionic membrane or, preferably, both the anodic electrocatalyst is removably in contact with the anolyte facing surface of the permionic membrane and the cathodic electrocatalyst is removably in contact with the catholyte facing surface of the permionic membrane. By removably in contact is meant that the catalyst is bonded to an electroconductive substrate, and neither bonded to nor embedded in the permionic membrane. The catalytic surface may be a coating or surface layer on the substrate, or a roughened, porous, or etched surface of the substrate, or an exterior surface of the substrate on which the reaction occurs. When the catalyst is referred to as being bonded to the substrate, it is to be understood that the substrate being the electrocatalyst is also encompassed thereby. In solid polymer electrolyte cells, the electrocatalyst is bonded to a surface of the permionic membrane. Solid polymer electrolyte electrolytic cells are described generally in U.S. Pat. Nos. 4,191,618 and 4,210,501, while zero gap permionic membrane electrolytic cells are described in the commonly assigned copending application of Donald W. DuBois et al filed Sept. 19, 1979, Ser. No. 76,898.

As described in the aforementioned United States Patents and Patent Application, the electrocatalyst is typically embedded in and surrounded by a hydrophobic material, e.g. sintered polytetrafluoroethylene, fluorinated ethylene-propylene, or perfluoroalkoxy materials. As there described, the catalyst is in the form of particles embedded in the hydrophobic material. As further described in the aforementioned United States Patents, there is substantially no deformation of the permionic membrane during the process of adhering the catalyst particles thereto, the sulfonyl type membranes disclosed therein having a softening temperature near the thermal decomposition temperature thereof.

Solid polymer electrolyte electrolytic chlor-alkali cells have a low cell voltage. It has been shown by DuBois et al that a zero-gap anode configuration exhibits substantially the same voltage and current efficiency characteristics as a solid polymer electrolyte cell configuration. However, a zero gap cathode, as described above, while having enhanced current efficiency over a solid polymer electrolyte cathode, has a higher voltage than a solid polymer electrolyte cathode.

It has now been found that advantages of a solid polymer electrolyte cathode, i.e., low voltage, and of a zero gap cathode, i.e., high current efficiency, may be obtained, while certain disadvantages of both solid polymer electrolyte cathodes and zero gap cathodes, i.e., susceptibility to perforation of the permionic membrane and imperfect membrane-electrode contact, may be avoided according to the invention described herein.

A novel zero gap cathode is contemplated herein. At least the cathode, and preferably the anode and cathode herein contemplated avoid the presence of aqueous electrolyte between the catalyst and the permionic membrane. According to a preferred exemplification, the electrode is characterized by a porous substrate, a catalytic coating bonded to the substrate, and a film of a cation selective, ion exchange material atop, within, and bonded to the catalyst. The resulting electrode has a resilient, partially deformable, electrically conductive surface thereon which may be pressed firmly against the permionic membrane. In this way, the presence of an electrolyte film between the electrocatalyst and permionic membrane is avoided, and substantially uniform contact is maintained across the electrode-permionic membrane interface.

According to one exemplification, the electrode has its active catalyst members, i.e., catalytic particles, wire, mesh, screen, or the like, bonded to a porous metallic substrate and to a hydrophilic, electrolyte resistant polymeric material which fully or partially surrounds the active catalyst materials. That is, the electrode is in the form of a porous, perforate, or foraminous substrate with a porous or a particulate, or a porous, particulate film of electrocatlayst bonded to the surface facing the anode and permionic membrane, with the electrocatalyst also bonded to a further film of hydrophilic, electrolyte resistant material above and within the film of electrocatalyst. The hydrophilic, electrolyte resistant, polymeric material above and within the electrocatalyst is referred to herein as the electrode polymer whereby to avoid confusion with the permionic membrane which separates the anolyte compartment from the catholyte compartment of the electrolytic cell.

Suitable hydrophilic, electrolyte resistant polymeric materials for the cathode include hydrocarbon and halogenated hydrocarbon polymers, characterized by the presence of acid, ester, or amide groups. Suitable materials for the anode are halogenated polymer characterized by the presence of the aforementioned groups. According to a particularly preferred exemplification of this invention, the electrode polymer is either the material used to prepare the permionic membrane or a material compatible with the permionic membrane.

The resulting electrodes, either anode or cathode or both, i.e., the catalyst and polymer coated wire, mesh, screen, or other porous substrate is maintained in contact with the membrane which separates the anolyte and catholyte compartments i.e. as an electrode of a permionic membrane electrolytic cell.

The catalytic electrodes herein contemplated are prepared by depositing electrocatalyst on an electroconductive substrate, i.e. by electrodeposition, electroless deposition, thermal decomposition of organometallics, application of a molten metal, leaching of a deposit, leaching of the substrate, or the like. The electrode surface is a porous surface, e.g., a surface having pores resulting from evaporating a low boiling solvent or dissolving or leaching a soluble component. Thereafter the hydrophilic resin, i.e., the electrode polymer, or a composition of the resin and electrocatalyst is bonded to the mesh, screen, or perforate sheet metallic current carrier or substrate whereby to form an electrode having electrocatalyst particles surrounded by and within a hydrophilic resin.

In the preparation of the electrodes, the hydrophilic, electrolyte resistant resin may initially be in the form of film, sheet, particles, spheres, comminutes, pulverizates, or the like, as from, e.g. crushing, grinding, or pulverizing an extrudate, film, sheets, strands, or the like. Alternatively, the resin may be in the form of a dispersion, colloid, latex, solution, or slurry.

According to one exemplification of the invention herein contemplated, the electrode polymer may be bonded to the substrate and electrocatalyst in a form having enhanced thermoplasticity, i.e., as a carboxylic acid, a low alkyl ester thereof, or an acid chloride, e.g., a carboxylic acid chloride or a sulfonic acid chloride. In this way, compensation for surface imperfections may be obtained, and thus insure good electrical contact and exclusion of the electrolyte. This may be accomplished by employing a hydrophilic resin having either lower equivalent weight than the membrane, or less cross linking than the membrane, or both.

DETAILED DESCRIPTION OF THE INVENTION

Zero gap permionic membrane chlor-alkali cells have a cation selective permionic membrane dividing the anolyte from the catholyte. The permionic membrane has either only cathodic electrocatalyst removably in contact with the catholyte facing surface thereof, or both cathodic electrocatalyst removably in contact with the catholyte facing surface and anodic electrocatalyst removably in contact with the anolyte facing surface. The electrocatalyst removably in contact with the permionic membrane is adherent to a catalyst carrier or current carrier or combination catalyst carrier and current carrier that is maintained removably in contact with the permionic membrane.

Herein contemplated is a zero gap permionic membrane electrolytic cell in which aqueous electrolyte is excluded from between the electrocatalyst and the permionic membrane. In this way, the electrolytic transport of ions through the aqueous electrolyte is substantially eliminated.

An ionically conducting, resilient, electrolyte resistant polymer, referred to herein as the electrode polymer, is interposed between the cation selective permionic membrane and the electrocatalyst, e.g., the cathode electrocatalyst. The electrode polymer may be joined to the permionic membrane, being deformable and resilient, whereby to avoid electrolyte between the cation selective permionic membrane and the catalyst. Preferably, the electrode polymer is a deposit on or is bonded to the catalyst, i.e., adhering to the catalyst, on and within the catalyst, whereby to exclude electrolyte from the catalyst.

As herein contemplated, the electrocatalyst is bonded to an electroconductive substrate and in contact with, essentially surrounded by, and preferably bonded to the ion exchange resin material of the electrode polymer. The electrode polymer ion exchange resin material may be deformable, e.g. a thermally and compressively deformable product of a thermoplastic form of the ion exchange resin material.

The contemplated structure of the ion exchange resin material that is bonded to the electrocatalyst is a thin electrolyte-wettable film, layer, or mass present on top of and within the electrocatalyst. The ion exchange resin material, i.e., the electrode polymer, may be either porous and gas permeable, or imporous to electrolyte flow.

As herein contemplated, the electrode substrate is a foraminous, thin, electroconductive, metallic structure, as exemplified by perforated plate, perforated sheet, screen, mesh, expanded mesh, sintered powder, leached sintered powder, or the like. Preferably the substrate has a thickness of from about 1 mil to about 100 mils, and from about 40 percent open area to about 80 percent open area.

As used herein, porosity encompasses pores, fissures, fractures, imperfections, peaks and valleys, and the like at which surface catalyzed or electron transfer chemical reactions may occur. That is, it may be a porous surface formed by codepositing an electrocatalytic first metal, resistant to leaching, and a leachable second metal, as codepositing iron, cobalt, nickel, molybdenum, and the like, with aluminum or zinc, and leaching out the leachable metal. Alternatively the electrocatalyst may be fine, porous particles, e.g., finer than minus 100 mesh. Especially preferred are particles finer than 325 mesh, i.e., minus 325 mesh particles.

Alternatively, the electrocatalyst and the substrate may be one porous mass, as porous graphite, porous stainless steel, or porous nickel, or a porous intercalation compound of graphite and a transition metal. The porous mass may be a sheet, a plate, a coupon, a film, or a layer. Alternatively, it may be a strand of porous material. Alternatively, the electrocatalyst may be the same material as the substrate, e.g., a stainless steel or nickel substrate with an external surface thereof being the electrocatalyst.

As herein contemplated, the film of electrode polymer, i.e., the film of ion exchange resin atop or within and atop the electrocatalyst, is from about 1 to about 20 mils thick. The film of electrode polymer may be electrolyte permeable, and is ion permeable.

As herein contemplated, when the electrode surface contains a deposited electrocatalyst the loading of electrode polymer basis total electrode polymer and electrocatalyst in the catalyst film, is from about 5 to about 95 percent weight, preferably from about 10 to about 80 weight percent, and in a particularly preferred exemplification from about 25 to about 75 weight percent. In this way a catalyst loading of from about 1.0 to about 25.0 milligrams of catalyst per square centimeter of permionic membrane, and a film thickness of about 0.5 to 25 mils is provided. Especially preferred is a catalyst loading of about 2 to 20 milligrams of catalyst per square centimeter of permionic membrane, and a film thickness of about 2 to 20 mils, although thicker or thinner film thicknesses may be utilized if desired without deleterious effect.

In a preferred exemplification the resin is applied to a porous electrocatalytic surface bonded to a substrate, e.g. a metallic catalyst carrier, under conditions where the resin is thermoplastic so as to deform, and adhere to the porous catalyst, which catalyst is in turn adherent to the substrate.

In an alternative exemplification, electrocatalyst particles and resin are applied directly to the substrate, e.g., metallic substrate, under conditions of temperature or pressure where the resin is thermoplastic so as to deform and cause both the resin and the electrocatalyst particles to adhere to the metallic substrate.

While the electrode polymer is spoken of as being a thermoplastic resin, a deformate of a thermoplastic resin, a latex, a slurry, or a solute, it is to be understood that the characterization thereof refers to its state at the time of fabrication of the catalyst carrier-catalyst-resin unit, and the resin may subsequently lose its thermoplastic character, e.g., by hydrolysis to the alkali metal salt, evaporation of the solvent or liquid medium or the like.

The resins herein contemplated, i.e., hydrophilic cation selective ion exchange resins, may have thermoplastic properties. These thermoplastic properties, when present, depend upon the substituents bonded to the active ion exchange groups, upon the presence of ether linkages, and upon the substantial absence of cross-linking. For example, perfluorinated resins having equal degrees of cross-linking and equal concentrations of ether linkages are thermoplastic in the ester form, thermoplastic, but less so, in the acid form, and substantially less thermoplastic in the alkali metal salt form. Additionally, the higher the concentration of ether linkages, the more thermoplastic and deformable the resin.

According to one exemplification herein contemplated, the hydrophilic electrode resin is an ion exchange that is present in either the ester, amide, or acid halide form, and preferably in the ester or amide form for a carboxylic acid, and in the acid halide form for either a phosphorous acid or a sulfonic acid, during formation of the metallic substrate-catalyst-resin unit.

According to an alternative exemplification, the coating, layer or film of the hydrophilic electrode resin on the electrocatalyst may be applied thereto as a dispersion, colloid, or latex, with subsequent melting, partial melting, crosslinking, oxidation or coagulation of the resin, or evaporation of the solvent, medium, or carrier, or a combination of one or more of these treatments.

According to a preferred exemplification, application of the resin to the catalyst coated metallic substrate, including the coapplication of the resin and electrocatalyst to the metallic substrate, is carried out at elevated temperature and pressure whereby to render the resin flowable, deformable, tacky, or partially molten, thereby causing the resin to adhere to the catalyst and the substrate. The temperature range herein contemplated is high enough at the pressure employed to give the resin a volumetric flow rate above about 0.01 cubic millimeter per second, but below the thermal decomposition temperature of the resin. The temperature necessary to provide the above recited volumetric flow rate is a function of the pressure, the substituents in the resin, the extent of cross linking, and the degree of polymerization, and can be found by routine testing. As a practical matter this temperature will be at least about 70° C., and generally from about 90° C. to about 250° C.

The temperature and elevated pressure, if any, are maintained until the electrocatalyst particles are set into the resin, and the mass of resin and electrocatalyst is adherent to the substrate, e.g., from about 1 minute to about 5 hours.

Specific combinations and permutations of time, pressure, and temperature, within the above recited ranges herein contemplated are dependent upon the resin, and the size of the resin particles and the electrocatalyst particles, and may be determined by routine testing.

The resin may, as a matter of convenience, be the same halogenated hydrocarbon ion exchange material as the permionic membrane. When the hydrophilic, thermoplastic resin differs from the permionic membrane, the thermoplastic resin may have either a higher or a lower glass transition temperature than the permionic membrane for a given volumetric flow rate, as described above. Alternatively, the resin and the permionic membrane may have similar halocarbon backbones, differing in either ion selective substituents, or physical properties, e.g. thermoplastic properties, or both. A preferred example of the resin herein contemplated is a polymeric, halogenated hydrocarbon, preferably, a fluorinated hydrocarbon, having immobile, polar or cation selective ion exchange groups on a halocarbon backbone.

The permionic membrane interposed between the anolyte and the catholyte is also a polymeric, halogenated hydrocarbon having immobile, cation selective ion exchange groups on a halocarbon backbone. The membrane may be from about 2 to about 10 mils thick, although thicker or thinner permionic membranes may be utilized. By pressing the resin coated electrode assembly tightly against the permionic membrane interposed between the anolyte and catholyte, an electrode membrane electrode assembly having a thickness of from about 3 to about 40 mils is provided. The permionic membrane may be a laminate of two or more membrane sheets. It may have been chemically modified on either or both surfaces. It may, additionally, have internal or eternal reinforcing fibers.

Both the permionic membrane and the polymer deposited on the metallic electrode substrate atop the catalyst may be copolymers of (I) a fluorovinyl polyether having pendant ion exchange groups and having the formula:

$$CF_2{=}CF{-}O_a{-}[(CF_2)_b(CX'X'')_c(CFX')_d(CF_2{-}O{-}(X'X'')_e(CX''X'O{-}CF_2)_f]{-}A \quad (I)$$

where a is 0 or 1, b is 0 to 6, c is 0 to 6, d is 0 to 6, e is 0 to 6, f is 0 to 6; X, X', X''are —H, —Cl, —F, and $-(CF_2)_gCF_3$; g is 1 to 5; [ ] is a discretionary arrangement of the moieties therein; and A is the pendant ion exchange group as will be described hereinbelow. Preferably a is 1, and X, X', X'' are —F and $(CF_2)_gCF_3$.

The fluorovinyl polyether may be copolymerized with a (II) fluorovinyl compound:

$$CF_2{=}CF{-}O_a{-}(CFX''_d){-}A, \quad (II)$$

and a (III) perfluorinated olefin:

$$\text{(III) } CF_2{=}CXX', \quad (III)$$

or (I) may be copolymerized with only a (III) perfluorinated olefin, or (I) may be copolymerized with only a (II) perfluorovinyl compound.

The ion exchange group is a cation selective group. It may be a sulfonic group, a phosphoric group, a carboxylic group, a precursor thereof, or a reaction product thereof, e.g. an ester or amide thereof. Carboxylic groups, precursors thereof, and reactions products thereof are preferred. Thus, as herein contemplated, A is preferably chosen from the group consisting of

—COOH, $-COOR_1$,

—COOM,

—COF,

—COCl,

—CN, $-CONR_2R_3$, $-SO_3H$, $-SO_3M$, $-SO_2F$, and $-SO_2Cl$ where $R_1$ is a $C_1$ to $C_{10}$ alkyl group, $R_2$ and $R_3$ are hydrogen or $C_1$ to $C_{10}$ alkyl groups, and M is an alkali metal or a quaternary ammonium group. According to a particularly preferred exemplification A is $-COF$, $-COCl$, $-COOH$, $-COOR_1$, $-SO_2F$, or $-SO_2Cl$ where $R_1$ is a $C_1$ to $C_5$ alkyl.

The permionic membrane material herein contemplated has an ion exchange capacity of from about 0.5 to about 2.0 milliequivalents per gram of dry polymer, preferably from about 0.9 to about 1.8 milliequivalents per gram of dry polymer, and in a particularly preferred exemplification, from about 1.0 to about 1.6 milliequivalents per gram of dry polymer. The permionic membrane herein contemplated has a volumetric flow rate of 100 cubic millimeters per second at a temperature of 150 to 300 degrees Centigrade, and preferably at a temperature between 160 to 250 degrees Centigrade. The glass transition temperature of the permionic membrane polymer is below 70° C., and preferably below about 50° C.

The permionic membranes herein contemplated may be prepared by the methods described in U.S. Pat. No. 4,126,588, the disclosure of which is incorporated herein by reference.

While the hydrophilic resin utilized in combination with the electrocatalyst has been referred to as being formed of permionic membrane material or of ion exchange resin material, it is to be understood that the resin may be more or less elastic and more or less thermoplastic than the ion-exchange material used in the fabrication of the permionic membrane.

As herein contemplated in a preferred embodiment both the permionic membrane and the electrode resin may be copolymers which may have:

(I) fluorovinyl ether acid moieties derived from $$CF_2{=}CF{-}O{-}[(CF_2)_b(CX'X'')_c(CFX')(CF_2{-}O{-}CX'X'')_e(CX'X''{-}O{-}CF_2)_f]{-}A,$$

and exemplified by $CF_2{=}CFOCF_2CF(CF_3)OCF_3CF_2CF_2COOOCH_3$, $CF_2{=}CFO(CF_2)_3OCFCOOCH_3$, $CF_3$ $CF_2{=}CFO(CF_2)_4OCFCOOCH_3$, $CF_3$ $CF_2{=}CFOCF_2CFCF_2COOCH_3$, and $CF_3$ $CF_2{=}CFOCF_2CF(CF_3)OCF(COOCH_3)CF_3$, inter alia;

(II) fluorovinyl moieties derived from $$CF_2{=}CF{-}(O)_a{-}(CFX')_d{-}A,$$

exemplified by $CF_2{=}CF(CF_2)_{2-4}COOCH_3$, $CF_2{=}CF(CF_2)_{2-4}COOCH_3$, $CF_2{=}CFO(CF_2)_{2-4}COOCH_3$, $CF_2{=}CFO(CF_2)_{2-4}COOC_2H_5$, and $CF_2{=}CFO(CF_2)_{2-4}COOCH_3$, inter alia;

(III) fluorinated olefin moieties derived from $CF_2{=}CXX'$ as exemplified by tetrafluoroethylene, trichlorofluoroethylene, hexafluoropropylene, trifluoroethylene, vinylidene fluoride, and the like; and (IV) vinyl ethers derived from $CF_2{=}CFOR_4$;

with the ether linkage content of the electrode resin being less than, equal to, or higher than the ether linkage content of the permionic membrane.

While the above resins are illustrated as carboxylic acid esters, it is to be understood that phosphonyl halide or sulfonyl halide resins, e.g., sulfonyl chloride resins, capable of thermoplastic behavior may also be used.

In a preferred exemplification, a film of either resin or resin and electrocatalyst particles is bonded to a catalyst bearing mesh, screen, perforated metal film, or sintered powder, which serves as, e.g. a catalyst carrier and a current collector. The film, i.e., the film of either electrocatalytic particles and resin, or only of resin is present on the metal structure as a thin, electrolyte-wettable sheet, layer, film, web, or the like, which may be either porous or non-porous, and either gas permeable or essentially non-gas permeable, and which may either coat individual fibers, particles, or strands or bridge adjacent apertures, fibers or strands of the current collector-catalyst carrier. The film of catalyst particles and resin on the porous electrode current collector-catalyst carrier bears upon the permionic membrane when the electrolysis cell is assembled and in operation.

According to an alternative exemplification, the electrolytic cell may be a hybrid electrolytic cell with one zero gap electrode assembly as described above, and one catalytic electrode bonded to and embedded in the membrane. According to a still further alternative exemplification, the electrolytic cell may be a hybrid electrolytic cell with one electrode assembly having a film of catalyst particles removably bearing upon the permionic membrane, e.g., as an anode, and the opposite electrode assembly having a bonded film of catalyst particles and resin bearing upon the permionic membrane, e.g., as a cathode.

Various electrocatalysts may advantageously be used. For example, the electrocatalysts may be graphite, metals, or various metallic compounds. The electrocatalyst may be the surface of the electrode substrate. When graphite is referred to herein, the intercalation compounds thereof, e.g., with either fluorine or transition metals, are encompassed thereby.

The electrocatalyst particles are preferably fine mesh particles, e.g. particles smaller than 100 mesh. Especially preferred are particles smaller than 325 mesh, i.e., minus 325 mesh particles. Such fine particles, e.g. nickel particles finer than 325 mesh, may be pyrophoric and require processing in inert atmospheres or organic solvents, e.g. hydrocarbons, alcohols, ketones, ethers, and the like, or in water.

One particularly satisfactory group of electrocatalysts are the oxides of the platinum group metals, especially oxides of enhanced surface area. Alternatively, the oxides of the platinum group metals may be present with oxides or oxycompounds of other metals. The other metal oxides may be oxides of titanium, tungsten, tantalum, niobium, vanadium, and the like. The oxide of the second metal may be present as conductive powders or particles of low chlorine overvoltage, or as mixed crystals, intermetallic oxides, intermetallic oxycompounds, or the like, e.g. spinels, perovskites, and delafossites, with the oxides of the platinum group metal.

One particularly desirable group of electrocatalysts that may be used with the resin coated electrodes as herein contemplated are the thermal decomposition products of halides of platinum group metals, e.g. ruthenium, iridium, and ruthenium-iridium alloys. These catalysts are prepared by thermal decomposition of the halides under oxidizing conditions, followed by comminution, washing, reduction, e.g. with hydrogen or carbon monoxide, and further comminution, and washing.

The cathodic electrocatalysts may be porous deposits or particles of transition metals, e.g. iron, cobalt, nickel, and the like. Additionally, other materials may be present therewith, e.g. molybdenum with nickel to stabilize the hydrogen overvoltage characteristics of the nickel. The porous, cathodic electrocatalytic deposits or particles may be prepared by conventional means. Alternatively, the cathodic electrocatalysts may be porous graphite products, e.g., graphite, graphite intercalated with fluorine, or graphite intercalated with a transition metal.

As described hereinabove, the catalysts are typically applied by forming a composition of the electrode resin in a thermoplastic form and the catalyst particles. The resin may be in the form of a comminute, an extrudate, or the like. Thereafter the composition is rendered thermoplastic and applied to the substrate, e.g. catalyst bearing catalyst carrier or the catalyst carrier.

In a preferred embodiment, the cathodic electrocatalyst is deposited on and bonded to the porous substrate by electroplating or by electroless deposition from a suitable plating bath. The deposit may be a co-deposit of two metals, one of which is more leachable than the other. The more leachable may be leached out to activate the electrocatalyst, i.e., to render it porous and of enhanced surface area. The electrocatalyst is then treated with the electrode resin under conditions which cause the resin to flow over, on, and into the electrocatalyst, resulting in a firmly bonded assembly of the electrode resin, the electrocatalyst, and the porous electrode substrate.

According to the exemplification herein contemplated, a composition of 10 parts of a mixture of 60 weight percent iron fines and 40 weight percent nickel fines is mixed with 20 parts of perfluorinated carboxylic acid iron exchange resin fines, and applied to 10 mesh per inch nickel screen by heating to 200° C. at a pressure of 200 kilograms per square centimeter for ten minutes. A 10 mesh per inch titanium screen having a $TiO_2$13 $RuO_2$ coating is utilized as the anode.

A perfluorinated carboxylic acid permionic membrane is installed in an electrolytic cell between the above anode with a titanium mesh anodic current collector and the above described cathode with a copper mesh cathodic current collector. Electrolysis is commenced with an aqueous sodium chloride anolyte liquor and an aqueous sodium hydroxide catholyte liquor, whereby to evolve chlorine at the anodic catalytic surface, hydrogen at the cathodic catalytic surface, and hydroxyl ion in the catholyte liquor.

According to an alternative exemplification herein contemplated, a composition is prepared containing five parts NaOH-etched grade 316 stainless steel fines and three parts of the methyl alcohol ester of a perfluorinated carboxylic acid ion exchange resin material. This is applied to a nickel coated stainless steel wire mesh screen having a mesh of 8 filaments per inch by 8 filaments per inch, each filament being 0.03 inch diameter, and having 65 percent open area. The wire mesh screen and composition are heated to about 200° C., at a pressure of 150 kilograms per square centimeter for 20 minutes whereby to provide a resin impregnated catalytic cathode bonded to the wire mesh substrate.

As herein contemplated, each cathode carrier has a thin, electrolyte wettable film, sheet, layer or coating atop the porous, catalystbearing substrate. Depending upon the amount of resin employed, the catalytic cathode and resin coating on the porous substrate may itself be porous and gas permeable, or it may be non-porous and essentially gas impermeable.

According to a further alternative exemplification herein contemplated, a composition is prepared containing 1 part of fines of a rutileform crystalline material containing oxides of ruthenium and titanium and five parts of fines of a perfluorinated, carboxylic acid, ion exchange material. This is applied to a titanium screen catalyst carrier having a mesh of 10 filaments per inch by 10 filaments per inch, each filament being 0.03 inch diameter, having an open area of approximately 50 percent. The composition is pressed into the mesh at a pressure of about 175 kilograms per square centimeter and a temperature of 200° C. for 5 minutes.

According to a further alternative exemplification herein contemplated, a stainless steel wire mesh screen having 30 wire strands per inch is made cathodic and placed into a plating bath from which a thin coating of nickel and zinc is electrolytically deposited thereon. Zinc is removed from the deposit by leaching in a caustic soda solution. The resulting catalytically coated stainless steel mesh is rinsed, and then dried in an oxidant free atmosphere, i.e., an oxygen and $CO_2$ free atmosphere, and thereafter coated with a thin sheet of a perfluorinated carboxylic acid ion exchange resin in the methyl ester form. The catalytically coated wire mesh screen and ion exchange resin are heated to about 200° Centigrade at a pressure of about 150 kilograms per square centimeter for about 20 minutes whereby to provide a resin impregnated catalytic cathode bonded to the stainless steel wire mesh substrate.

The zero gap permionic membrane cell is assembled by compressing a permionic membrane between the anode and cathode units prepared as described above. Thereafter electrolysis may be commenced with an alkali metal chloride brine anolyte and a water or an aqueous alkali metal hydroxide catholyte.

Where the cathode assembly and the anode assembly are coated with deformable resin films on the surfaces pressing against the permionic membrane, it is a relatively simple matter to ensure high electrical conductivity therebetween, to exclude electrolyte therefrom, and to reduce the danger of perforation of the permionic membrane, e.g., during assembly of the electrolytic cell.

While the invention has been described with respect to certain Preferred exemplifications, embodiments, and illustrative examples, it is to be understood that the invention is not to be limited thereby, and that alternative exemplifications and embodiments are encompassed within the contemplated scope of the invention, the invention being limited solely by the claims appended hereto.

I claim:

1. A method of preparing an electrode comprising co-depositing a catalytic metal and a leachable metal on an electroconductive, metallic substrate, leaching out the leachable metal whereby to provide a porous, electrocatalytic surface on the metallic electroconductive substrate, treating a hydrophilic, electrolyte resistant, resin material deposited atop said porous electrocatalyst surface to cause the resin to flow and thereby obtain a firmly bonded assembly of resin, electrocatalyst and metallic substrate.

* * * * *